US012590763B2

(12) United States Patent
Feldkeller et al.

(10) Patent No.: US 12,590,763 B2
(45) Date of Patent: Mar. 31, 2026

(54) STACKED DISC HEAT EXCHANGER FOR A THERMAL MANAGEMENT MODULE

(71) Applicant: MAHLE International GmbH, Stuttgart (DE)

(72) Inventors: Timo Feldkeller, Asperg (DE); Anja Kies, Weil der Stadt (DE)

(73) Assignee: Mahle International GmbH (DE)

( * ) Notice: Subject to any disclaimer, the term of this patent is extended or adjusted under 35 U.S.C. 154(b) by 218 days.

(21) Appl. No.: 18/123,977

(22) Filed: Mar. 20, 2023

(65) Prior Publication Data

US 2023/0296330 A1 Sep. 21, 2023

(30) Foreign Application Priority Data

Mar. 21, 2022 (DE) ..... 10 2022 202 732.9

(51) Int. Cl.
*F28D 9/00* (2006.01)
*F28D 21/00* (2006.01)
*F28F 3/08* (2006.01)

(52) U.S. Cl.
CPC ..... *F28D 9/005* (2013.01); *F28D 21/00* (2013.01); *F28F 3/08* (2013.01); *F28D 2021/008* (2013.01)

(58) Field of Classification Search
CPC ..... F28D 9/005; F28D 9/0043; F28D 1/0333; F28D 1/0325; F28D 2021/0071;
(Continued)

(56) References Cited

U.S. PATENT DOCUMENTS 5,524,455 A * 6/1996 Hasegawa ..... F25B 41/335 62/527
5,724,817 A * 3/1998 Nishishita ..... F28F 9/0253 62/299
(Continued)

FOREIGN PATENT DOCUMENTS

CN 104169671 A 11/2014
CN 107850396 A 3/2018
(Continued)

OTHER PUBLICATIONS

English abstract for DE-10 2013 207 180.
(Continued)

*Primary Examiner* — Jianying C Atkisson
*Assistant Examiner* — For K Ling
(74) *Attorney, Agent, or Firm* — Fishman Stewart PLLC

(57) ABSTRACT

A stacked disc heat exchanger for a thermal management module may include a plurality of stacked discs arranged following one another in a stacking direction. Each stacked disc of the plurality of stacked discs may include a bottom extending transversely to the stacking direction. An outermost disc of the plurality of stacked discs in the stacking direction defining a cover disc. The cover disc may include at least one convexity formed in the stacking direction towards an outside. The at least one convexity may extend transversely to the stacking direction and may form a channel for a flow path extending through the stacked disc heat exchanger of a fluid. The cover disc may further include at least one opening that is open in the stacking direction towards the outside for fluidic connection with the thermal management module.

19 Claims, 2 Drawing Sheets

(58) Field of Classification Search
CPC ..... F25B 39/02; F25B 39/022; F25B 39/024; F25B 39/028; F28F 3/086
See application file for complete search history.

(56) References Cited

U.S. PATENT DOCUMENTS

| | | | | |
|---|---|---|---|---|
| 5,832,736 | A * | 11/1998 | Yoshioka | F28F 3/04 62/503 |
| 5,964,280 | A * | 10/1999 | Wehrmann | F28F 9/0246 165/145 |
| 7,748,442 | B2 * | 7/2010 | Kalbacher | F01M 5/002 165/166 |
| 11,274,884 | B2 | 3/2022 | Thomas | |
| 11,965,700 | B2 * | 4/2024 | Schumacher | F28F 9/0221 |
| 2006/0118283 | A1 * | 6/2006 | Hanafusa | F28D 1/0333 165/176 |
| 2010/0243200 | A1 * | 9/2010 | Baker, Jr. | F28D 9/005 165/41 |
| 2011/0174015 | A1 * | 7/2011 | Nagano | F25B 41/00 62/515 |
| 2014/0096935 | A1 * | 4/2014 | Cho | F25B 39/04 165/104.13 |
| 2015/0047818 | A1 | 2/2015 | Peskos | |
| 2015/0101781 | A1 * | 4/2015 | Kim | F28D 9/005 165/96 |
| 2015/0276328 | A1 * | 10/2015 | Huang | B23P 15/26 29/890.03 |
| 2015/0369115 | A1 * | 12/2015 | Kim | F28F 27/02 165/103 |
| 2017/0097179 | A1 * | 4/2017 | Martin | F25B 39/00 |
| 2018/0156544 | A1 | 6/2018 | Alahyari | |
| 2019/0154366 | A1 | 5/2019 | Mueller | |
| 2021/0239411 | A1 | 8/2021 | Draenkow | |
| 2022/0364793 | A1 * | 11/2022 | Chen | F28F 9/0265 |

FOREIGN PATENT DOCUMENTS

| | | | | |
|---|---|---|---|---|
| CN | 109312988 | A | 2/2019 | |
| CN | 113203304 | A | 8/2021 | |
| DE | 102004004975 | A1 | 8/2005 | |
| DE | 102011078136 | A1 | 12/2012 | |
| DE | 102013207180 | A1 | 10/2014 | |
| DE | 102015207593 | A1 | 10/2016 | |
| DE | 102020203892 | A1 | 10/2020 | |
| EP | 0614061 | A1 | 9/1994 | |
| EP | 2154465 | A2 | 2/2010 | |
| JP | 06272558 | A * | 7/2001 | F01P 11/08 |
| WO | 0146636 | A2 | 6/2001 | |
| WO | WO-0201124 | A1 * | 1/2002 | F25B 39/022 |

OTHER PUBLICATIONS

English abstract for DE-10 2015 207 593.
English abstract for EP-EP2154465A2.
Chinese Office Action and Search Report, CN202310255812.X, dated Nov. 1, 2025 (w_translation).

* cited by examiner

STACKED DISC HEAT EXCHANGER FOR A THERMAL MANAGEMENT MODULE

CROSS-REFERENCE TO RELATED APPLICATIONS

This application claims priority to German Patent Application No. DE 10 2022 202 732.9, filed on Mar. 21, 2022, the contents of which is hereby incorporated by reference in its entirety.

TECHNICAL FIELD

The present invention relates to a stacked disc heat exchanger for a thermal management module comprising stacked discs following one another in a stacking direction. Furthermore, the invention relates to a thermal management module having such a stacked disc heat exchanger.

BACKGROUND

A heat exchanger serves for exchanging heat between two fluids in a fluidically separated manner and is usually employed in an associated thermal management module. It is known to employ such a heat exchanger consisting of stacked discs, in the following also referred to as stacked disc heat exchanger. In addition to the heat exchanger, the thermal management module comprises further components. These components serve in particular the purpose of varying the flows of the fluid through the thermal management module and/or changing thermodynamic states of the fluid. Pipes and flanges are usually employed for the fluidic and mechanical connection between the different components of the thermal management module and the heat exchanger. This results in a complex production and assembly of the thermal management module with increased costs and increased assembly effort.

In order to reduce the assembly effort and the costs, different solutions are proposed in the prior art, for example in DE 10 2004 004 975 A1, DE 10 2020 203 892 A1, EP 0 614 061 A1, EP 2 154 465 A2, WO 01/46636 A2 as well as WO 02/01124 A1. These solutions include the milling of pipes or of flanges.

SUMMARY

The present invention deals with the object of stating for a stacked disc heat exchanger and for a thermal management module having such a stacked heat exchanger of the type mentioned at the outset improved or at least other embodiments, which eliminate in particular disadvantages from the prior art. In particular, the present invention deals with the object of stating for the stacked disc heat exchanger and for the thermal management module improved or at least other embodiments, which are characterised by reduced costs and/or a longer lifespan.

According to the invention, this object is solved through the subject matter of the independent claim(s). Advantageous embodiments are the subject matter of the dependent claim(s).

Accordingly, the present invention is based on the general idea of introducing into an outer most stacked disc of a stacked disc heat exchanger convexities for forming channels and openings, via which a fluidic connection of the stacked disc heat exchanger with a thermal management module is effected. Compared with solutions known from the prior art, in which pipes are milled, no or at least a reduced number of fluidic interfaces have to be thus provided. Besides a reduction of the production costs this results in avoiding or at least reducing potential leakage points. Reducing such leakage points results in avoiding damage caused in this regard and thus extending the lifespan of the stacked disc heat exchanger and of the associated thermal management module. Compared with the solutions known from the prior art, in which flanges are milled, the solution according to the invention offers the advantage that these are formed at least smaller so that the incurred use of material and production effort are reduced and the costs are thus lower.

According to the inventive idea, the stacked disc heat exchanger, which in the following is also referred to as heat exchanger in brief, comprises stacked discs following one another in particular stacked onto one another in a direction. In the following, the direction is also referred to as stacking direction. The respective stacked disc comprises a bottom extending transversely to the stacking direction. One of the, in the stacking direction outermost, stacked discs forms a cover disc of the heat exchanger. The cover disc comprises at least one convexity formed in the stacking direction to the outside, which extends transversely to the stacking direction and forms a channel for a flow path of a fluid leading through the heat exchanger. Further, the cover disc comprises at least one opening that is open in the stacking direction towards the outside for fluidically connecting with the thermal management module.

Advantageously, the heat exchanger comprises an, in the stacking direction, outermost plate-like disc located opposite the cover disc in the stacking direction, which in the following is also referred to as base plate. Advantageously, the base plate serves the purpose of placing the heat exchanger on a base and preferentially mounting the same on the base.

The flow path in the heat exchanger is delimited or defined by the stacked discs. This means that the stacked discs define a flow of the fluid through the heat exchanger.

Besides the fluid mentioned above, which in the following is also referred to as first fluid, a further fluid, which in the following is also referred to as second fluid, advantageously also flows through the heat exchanger during the operation. This means that advantageously, besides the flow path of the first fluid, which in the following is also referred to as first fluid path, a flow path of the second fluid, which in the following is also referred to as second flow path, advantageously leads through the heat exchanger. The flow paths lead through the heat exchanger fluidically separated from one another, so that in the heat exchanger a fluidically separated heat transfer between the fluids occurs.

As explained above, the heat exchanger is employed in a thermal management module. The heat exchanger is fluidically connected with the thermal management module via the channels and openings. Thus, a flow path, for example the first flow path, leads through the thermal management module and the stacked disc heat exchanger. Preferably, the thermal management module comprises a block attached to the cover disc, through which the flow path leads. In addition, the thermal management module comprises at least one component separate from the stacked disc heat exchanger that is attached to the block, through which the flow path leads. The block and/or at least one of the at least one components are/is fluidically connected with at least one of the at least one openings of the stacked disc heat exchanger.

Preferably, the thermal management module, in the following also referred to as module in brief, is attached to the cover disc via the block. This results in a simplified assembly and production of the thermal management module.

Basically it is conceivable that both such a component and also the block are each directly connected fluidically with the heat exchanger via an associated opening.

In preferred embodiments, the fluidic connection between the thermal management module and the heat exchanger exclusively takes place via the block. This means that the block is directly connected with at least one opening of the cover disc and the fluidic connection of the components with the heat exchanger takes place via the block. Thus, the block functions as flange for the fluidic and mechanical connection with the cover disc or comprises at least such a flange. This results in a substantial reduction of possible interfaces with the heat exchanger and a substantial reduction of the assembly effort. This means that in this way both the costs are reduced and also the lifespan increased.

Advantageously, the block comprises at least one hollow space formed in the block, through which the flow path leads. With the at least one hollow space it is possible to fluidically connect at least one component to the heat exchanger. Accordingly it is advantageous when at least one of the at least one components is fluidically connected with at least one of the hollow spaces.

The fluid flowing through the heat exchanger and/or the module can be any fluid.

Advantageously, the fluid is a refrigerant.

The stacked disc heat exchanger can be equipped for any heat exchange with the fluid, in particular with the refrigerant. In particular, the stacked disc heat exchanger can be a chiller, an internal heat exchanger and the like. In particular, the stacked disc heat exchanger is one that evaporates the fluid, in particular the refrigerant during the operation.

Preferably, the stacked disc of the heat exchanger is produced from a thin metallic material, preferentially from sheet metal. Besides reduced production costs, this results in an advantageous heat exchange within the heat exchanger and thus an efficiency increase. The stacked discs of the heat exchanger can thus be in particular sheet metal discs.

Basically, the openings for the fluidic connection with the module can each be separate from the at least one channel, i.e. spaced apart from the same.

It is also conceivable that at least one of the at least one channels comprises such an opening. In particular it is conceivable that the respective channel comprises at least one such opening. Thus, the assembly effort and/or the number of the interfaces are reduced. Besides reduced production costs, this results in a reduction of possible leakage points and consequently in an increased lifespan.

Embodiments are considered preferable, in which at least one of the at least one convexities, particularly preferably the respective convexity, is stamped into the bottom of the cover disc. This means that at least one of the convexities, preferentially the respective convexity, is moulded into the bottom of the cover disc. This results in a simplified and cost-effective production of the heat exchanger.

In advantageous embodiments, at least one of the at least one openings, preferably the respective opening, is formed as a recess in the bottom of the cover disc. At least one of the openings, preferably the respective opening, is thus formed in that material is recessed, in particular cut out of the bottom of the cover disc. At least one of the openings, preferentially the respective opening, can thus be in particular a hole in the bottom of the cover disc. Thus, a simple and cost-effective production of the heat exchanger is effected.

Basically, the respective opening can be formed flat in the bottom.

In preferred embodiments, at least one of the at least one openings, advantageously the respective opening, can be formed in a connecting piece of the cover disc projecting in the stacking direction to the outside. This results in a simplified fluidic and mechanical connection of the heat exchanger to the module.

Advantageous are embodiments, in which at least one of the at least one connecting pieces, preferably the respective connecting piece, is stamped into the bottom of the cover disc. At least one of the connecting pieces, preferably the respective connecting piece, is thus moulded in the bottom. This results in a simplified and cost-effective production of the heat exchanger.

Embodiments are considered advantageous in which the openings for the fluidic connection with the module are arranged on a plane. Thus, the fluidic and mechanical connection of the heat exchanger with the module is substantially simplified. As a consequence, the assembly effort is reduced and thus the production costs lowered.

It is advantageous, further, when the at least one opening and the at least one channel terminate in a plane running transversely to the stacking direction. This results in a further reduction of the assembly effort and thus in further reduced production costs.

It is to be understood that the cover disc can comprise a further opening, which does not serve for fluidically connecting to the module. It is conceivable, in particular, that the cover disc comprises an opening via which the heat exchanger is supplied with the other fluid.

The respective component of the thermal management module serves in particular the purpose of changing during the operation the flow of the fluid flowing through the heat exchanger and the module and/or changing the fluid thermodynamically. Insofar, the stacked disc heat exchanger is likewise a component of the thermal management module.

The thermal management module can comprise in particular further heat exchangers.

Advantageously, the thermal management module comprises an expansion valve as component. The expansion valve expands during the operation the fluid flowing through the module and the heat exchanger. It is advantageous when the fluid connection between the expansion valve and the heat exchanger takes place via the block. This means that preferably no direct fluidic connection exists between the expansion valve and the heat exchanger. This results in a reduction of possible interfaces and consequently, as described above, in an increased lifespan and a reduced assembly effort and thus reduced costs. Preferably, the expansion valve is directly attached to the block.

Alternatively or additionally, the module can comprise as component a valve for changing the flow of the fluid flowing through the heat exchanger and the module. The valve is preferentially attached exclusively to the block and thus not connected directly to the heat exchanger fluidically. Preferentially, the valve is thus fluidically connected with the block. This results in a reduction of required interfaces and thus, as explained above, in reduced costs and an increased lifespan.

It is conceivable to attach the valve on the side of the block facing away from the cover disc. Thus, the block and consequently the module can be attached to the cover disc in a simplified manner. As a consequence, the assembly effort and thus the production costs are reduced. In addition, an improved access to the valve is effected in this manner.

Basically, the valve can be of any design. Advantageously, the valve is a multi-way valve. Thus, the module can be provided in a more cost-effective and/or compact manner. For example, the valve can be a three-way valve.

It is conceivable that the module as component comprises a collector for collecting the fluid flowing through the heat exchanger and the module. The collector serves in particular for balancing the fluid flowing through the heat exchanger and the module. It is preferred when the collector is exclusively connected with the block. This means that a fluidic connection between the collector and the heat exchanger takes place via the block. A separate fluidic connection with the heat exchanger is thus not required, so that the required interfaces are reduced. As a consequence, the costs are reduced and the lifespan increased.

Basically, the collector can be one of any type. In particular, the collector can be formed cylindrically. Preferably, the collector is a high-pressure collector.

In advantageous embodiments, the collector is attached to the block on an outer side transversely to the stacking direction and spaced apart from the stacked disc heat exchanger. Thus, the module can be attached to the heat exchanger via the block in a simplified manner. As a consequence, the assembly effort and the production costs are reduced. In addition, it is also possible in this manner to form the collector larger.

Basically, the thermal management module can be employed in any applications.

It is conceivable in particular to employ the thermal management module in a motor vehicle. Accordingly, the thermal management module is configured in particular with respect to the dimensions and/or to the weight and/or to the performance.

Further important features and advantages of the invention are obtained from the subclaims, from the drawings and from the associated figure description by way of the drawings.

It is to be understood that the features mentioned above and still to be explained in the following cannot only be used in the respective combination stated but also in other combinations or by themselves without leaving the scope of the present invention.

Preferred exemplary embodiments of the invention are shown in the drawings and are explained in more detail in the following description, wherein same reference numbers relate to same or similar or functionally same components.

BRIEF DESCRIPTION OF THE DRAWINGS

It shows, in each case schematically

DETAILED DESCRIPTION

Figure 1:
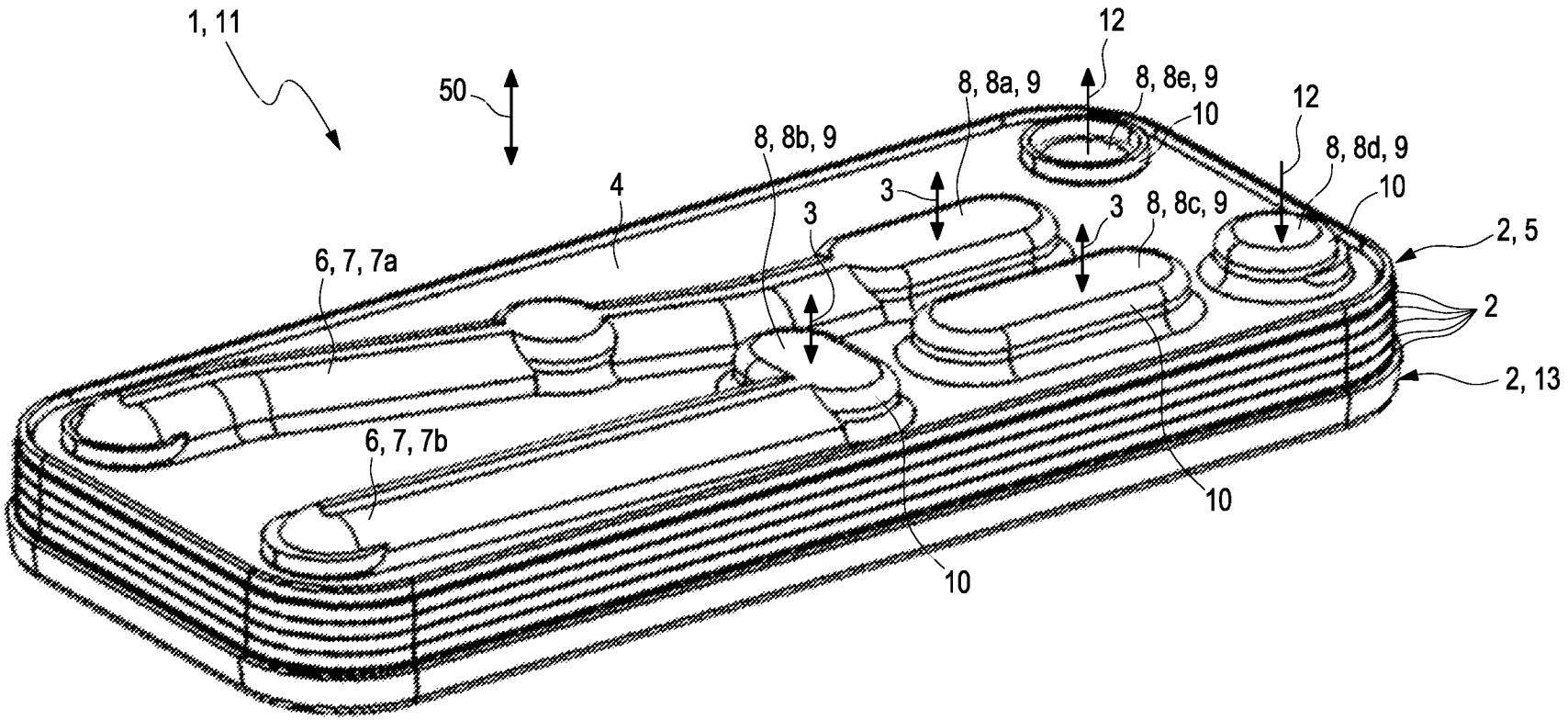
FIG. 1 shows an isometric view of a stacked disc heat exchanger.
Figure 2:
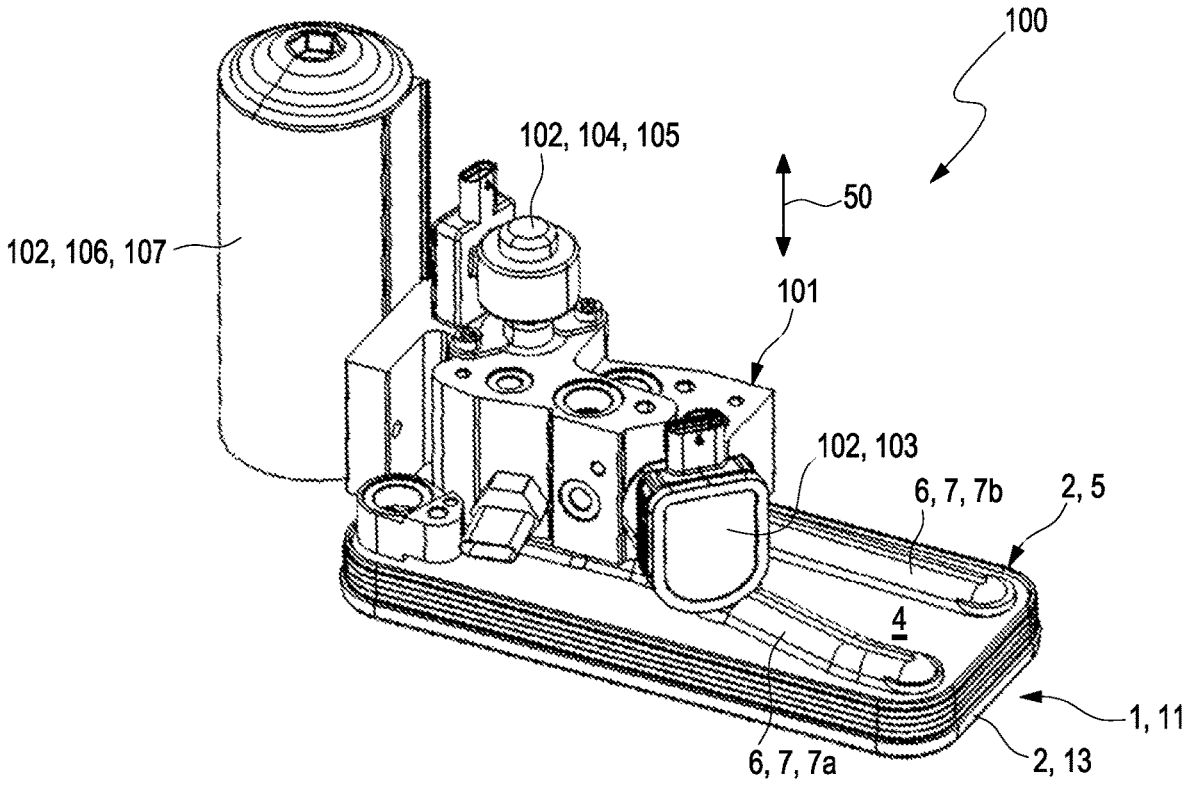
FIG. 2 shows an isometric view of a thermal management module having the stacked disc heat exchangers.
Figure 3:
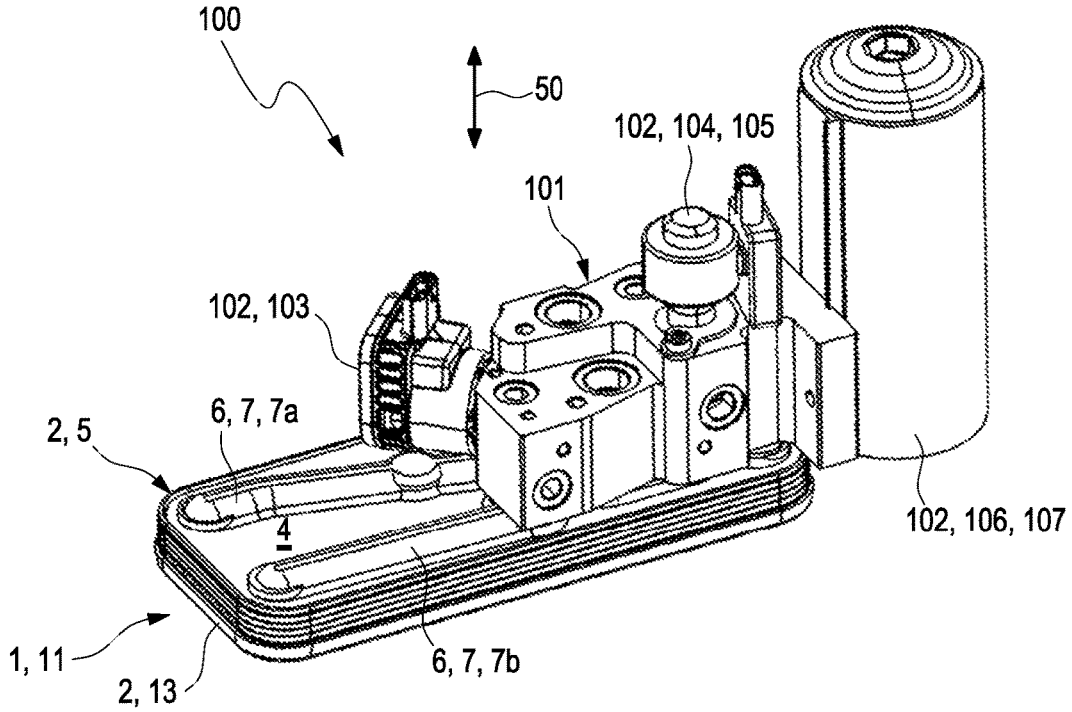
FIG. 3 shows another isometric view of the thermal management module.

A stacked disc heat exchanger 1, as is exemplarily shown in the FIGS. 1 to 3, is employed in a thermal management module 100, as is exemplarily shown in the FIGS. 2 and 3. The thermal management module 100 can be employed in a motor vehicle that is not shown.

In a direction 50, the stacked disc heat exchanger 1 comprises stacked discs 2 following one another. In the following, the direction 50 is also referred to as stacking direction 50. The respective stacked disc 2 comprises a bottom 4 extending transversely to the stacking direction 50. The respective stacked disc 2 is preferentially produced from a thin metallic material, in particular from sheet metal (not shown). An, in stacking direction 50, outermost disc of the stacked discs 2 forms a cover disc 5 of the stacked disc heat exchanger 1. In the figures, because of the view, only the bottom 4 of the cover disc 5 is visible. A flow path 3 of a fluid leads through the stacked disc heat exchanger 1, which in the following is also referred to as heat exchanger 1 in brief, as is indicated by arrows in FIG. 1. The fluid in the shown exemplary embodiments is a refrigerant. In the following, the flow path 3 is also referred to as first flow path. During the operation, a fluidically separate heat exchange between the refrigerant and another fluid, which in the following is also referred to as second fluid, occurs in the heat exchanger 1. This means that a further flow path 12 for the second fluid leads through the heat exchanger 1, as indicated by arrows in FIG. 1. In the following, the flow path 12 is also referred to as second flow path 12. The first flow path 3 and the second flow path 12 thus lead fluidically separated from one another through the heat exchanger 1. Within the heat exchanger 1, the flow paths 3, 12 are delimited by and separated from one another by the stacked discs 2. Further, the heat exchanger 1 comprises an, in the stacking direction 50, outermost disc 2 located opposite the cover disc 5, which in the following is also referred to as base plate 13. By means of the base plate 13, the heat exchanger 1 can be placed onto an object which is not shown and in particular mounted to the object.

By means of the thermal management module 100, in the following also referred to as module 100 in brief, flows and/or thermodynamic changes of the fluid flowing along the flow path 3, i.e. in the shown exemplary embodiment of the refrigerant, are realised. For this purpose, the thermal management module 100, as is evident from the FIGS. 2 and 3, comprises corresponding components 102, through which the flow path 3 leads. In addition, the module 100 comprises a block 101, to which the components 102 are attached. In the exemplary embodiment shown in the FIGS. 2 and 3, the module 100 as component 102 comprises an expansion valve 103 for expanding the refrigerant and a valve 104 for regulating the flow of the fluid along the flow path 3. In the exemplary embodiment, the valve 104 is designed as a multi-way valve 105, for example as a three-way valve 105. In addition, the module 100 comprises a collector 106 for collecting the refrigerant, which in the shown exemplary embodiment is designed as high-pressure collector 107.

In order to establish a simplified and cost-effective mechanical and fluidic connection between the module 100 and the heat exchanger 1, the cover disc 5 of the heat exchanger 1, as is evident in particular from FIG. 1, comprises at least one convexity 6 formed in the stacking direction 50 to the outside. The respective at least one convexity 6 extends transversely to the stacking direction 50, in the shown exemplary embodiment longitudinally, and forms a channel 7 for the refrigerant, thus delimits the flow path 3. In addition, the cover disc 5 comprises at least one opening 8 open in the stacking direction 50 towards the outside for the fluidic connection with the module 100. Thus, further, the number of the interfaces between heat exchanger 1 and the module 100 is reduced. Accordingly, possible leakages caused by such interfaces can be reduced. As a consequence, damage caused by such leakages is avoided or at least reduced and thus the lifespan of the heat exchanger 1 and of the module 100 increased.

In the shown exemplary embodiment, the cover disc 5 comprises two such convexities 6 or channels 7, which in the following are also referred to as first channel 7*a* and second channel 7*b*. In addition, the cover disc 5 comprises three such openings 8 for the fluidic connection with the module 100. In the shown exemplary embodiment, the first channel 7*a* comprises one such opening 8, which in the following is also referred to as first opening 8*a*. In addition, the second channel 7*b* comprises one such opening 8, which in the following is also referred to as second opening 8*b*. In the shown exemplary embodiment, the cover disc 5 comprises one such opening 8 separate from the channels 7, which in the following is also referred to as third opening 8*c*. In the exemplary embodiment shown in the FIGS. 2 and 3, the module 100 is fluidically connected with the heat exchanger 1 by means of the first to third opening 8*a*-8*c*. This means that the first flow path 3, as indicated in FIG. 1, leads through the first to third opening 8*a*-8*c*.

In the exemplary embodiment shown in the FIGS. 2 and 3, it is assumed that the heat exchanger 1 further cools the liquid refrigerant during the operation, i.e. is designed as an internal heat exchanger 11. Gaseous refrigerant from the module 100 can flow via the second channel 7*b* into the heat exchanger 1 and condensed refrigerant out of the heat exchanger 1 via the first channel 7*a* into the module or vice versa.

In the exemplary embodiment shown in the FIGS. 2 and 3, the block 101 is directly connected fluidically with the first to third opening 8*a*-8*c* and serves as a common flange. The flow of the refrigerant to the components 102 thus takes place via the block 101. Thus, the flow path 3 leads between the first to third opening 8*a*-8*c* and the block 101 and via the block 101 to the components 102.

As is evident from the FIGS. 1 to 3, the cover disc 5 in the shown exemplary embodiments comprises two further openings 8 which serve for the supply of the heat exchanger 1 with the second fluid and in the following are also referred to as fourth opening 8*d* and fifth opening 8*e*. By way of the fourth opening 8*d* and fifth opening 8*e* the second fluid can flow into and out of the heat exchanger 1. This means that the second flow path 12, as indicated in FIG. 1, leads through the fourth opening 8*d* and fifth opening 8*e*.

As is evident in particular from FIG. 1, the convexities 6 in the shown exemplary embodiments are each stamped into the bottom 4 of the cover disc 5, i.e. are moulded in the bottom 4. In addition, the respective opening 8 in the shown exemplary embodiments is recessed in the bottom 4, i.e. a recess 9 is formed in the bottom 4 of the cover disc 5. As is evident in particular from FIG. 1, the openings 8 spaced apart from the channels 7 are each formed in the shown exemplary embodiments in a connecting piece 10 of the cover disc 5 projecting in the stacking direction 50 towards the outside. The respective connecting piece 10 is stamped into the bottom of the cover disc 5, i.e. moulded in the bottom 4. As is evident, further, in particular from FIG. 1, the openings 8 shown in the exemplary embodiments for connecting the module 100, i.e. the first to third opening 8*a*-8*c*, and the respective channel 7 terminate in a plane (not shown) running transversely to the stacking direction 50. In this way, connecting the heat exchanger 1 with the module 100 is simplified.

As is evident from the FIGS. 2 and 3, the valve 104, in the shown exemplary embodiment, is attached on the side of the block 101 facing away from the cover disc 5 and fluidically connected with the block 101. In addition, the collector 106 in the shown exemplary embodiment is attached on a, transversely to the stacking direction 50, outer side and spaced apart from the stacked disc heat exchanger 1 to the block 101 and fluidically connected with the block 101.

The invention claimed is:

1. A thermal management module, comprising:

a stacked disc heat exchanger including a plurality of stacked discs arranged following one another in a stacking direction;

each stacked disc of the plurality of stacked discs including a bottom extending transversely to the stacking direction;

an outermost disc of the plurality of stacked discs in the stacking direction defining a cover disc;

the cover disc including at least one convexity formed in the stacking direction towards an outside, the at least one convexity extending transversely to the stacking direction and forming a channel for a flow path extending through the stacked disc heat exchanger of a fluid;

a block attached to the cover disc; and at least one component attached to the block;

wherein the cover disc further includes at least one opening that is open in the stacking direction towards the outside;

wherein the block and/or the at least one component is fluidically connected with the at least one opening;

wherein the flow path extends through the stacked disc heat exchanger, the block, and the at least one component;

wherein the at least one component includes i) a collector for collecting the fluid, ii) a first valve, and iii) a second valve; and wherein the first valve and the second valve are each attached to the block and fluidically connected with the block.

2. The thermal management module according to claim 1, wherein:

the at least one opening is disposed in the at least one convexity;

the at least one opening is a recess disposed in the bottom of the cover disc; and/or the channel includes the at least one opening.

3. The thermal management module according to claim 1, wherein the at least one convexity is stamped into the bottom of the cover disc.

4. The thermal management module according to claim 1, wherein:

the cover disc further includes a connecting piece projecting towards the outside in the stacking direction; and the at least one opening is disposed in the connecting piece.

5. The thermal management module according to claim 4, wherein the connecting piece is stamped into the bottom of the cover disc.

6. The thermal management module according to claim 4, wherein the at least one opening and the channel terminate in a plane extending transversely to the stacking direction.

7. The thermal management module according to claim 1, wherein the block and/or the at least one component is directly connected fluidically with the at least one opening.

8. The thermal management module according to claim 1, wherein the collector is attached to an outer side of the block facing transversely to the stacking direction, is disposed spaced apart from the stacked disc heat exchanger, and is fluidically connected with the block.

9. The thermal management module according to claim 1, wherein the collector is a pressurized fluid collection tank.

10. The thermal management module according to claim 1, wherein:

the first valve and/or the second valve is a multi-way valve; and the multi-way valve is attached to a side of the block facing away from the cover disc.

11. The thermal management module according to claim 1, wherein the at least one convexity is structured as a hollow dome projecting from the bottom of the cover disc.

12. The thermal management module according to claim 1, wherein:

the at least one opening includes a plurality of openings;

the at least one convexity includes a plurality of convexities;

the cover disc further includes a connecting piece disposed on the bottom spaced apart from the plurality of convexities and projecting towards the outside in the stacking direction;

a first opening of the plurality of openings is disposed in the connecting piece; and a second opening of the plurality of openings is disposed in a first convexity of the plurality of convexities and is in direct fluid communication with a first channel defined by the first convexity.

13. The thermal management module according to claim 1, wherein:

the block includes at least one hollow space disposed in and defined by the block; and the at least one component is in fluid communication with the heat exchanger via the at least one hollow space of the block and the at least one opening of the heat exchanger.

14. The thermal management module according to claim 1, wherein:

the first valve is an expansion valve configured to expand the fluid; and the second valve is a flow-regulation valve configured to regulate a flow of the fluid along the flow path.

15. A thermal management module, comprising:

a stacked disc heat exchanger including a plurality of stacked discs arranged following one another in a stacking direction;

an outermost disc, relative to the stacking direction, of the plurality of stacked discs defining a cover disc;

the cover disc including:

a bottom extending transversely to the stacking direction;

at least one elongated hollow dome projecting from the bottom away from a disc of the plurality of stacked discs that is disposed adjacent to the cover disc in the stacking direction, the dome extending along the bottom transversely to the stacking direction and at least partially defining a channel through which a refrigerant is flowable; and at least one opening via which the cover disc is fluidically connectable to a thermal management module;

a block attached to the cover disc; and at least one component attached to the block;

wherein the block and/or the at least one component is fluidically connected with the at least one opening;

wherein a flow path of the refrigerant extends through the heat exchanger, the block, and the at least one component;

wherein the at least one component includes i) a collector for collecting the refrigerant, ii) a first valve, and iii) a second valve; and wherein the first valve and the second valve are each attached to the block and fluidically connected with the block.

16. A thermal management module, comprising:

a stacked disc heat exchanger including a plurality of stacked discs arranged following one another in a stacking direction;

an outermost disc, relative to the stacking direction, of the plurality of stacked discs defining a cover disc;

the cover disc including:

a bottom extending transversely to the stacking direction;

a plurality of connecting pieces arranged on the bottom;

a plurality of elongated hollow domes projecting from the bottom, the plurality of domes extending along the bottom transversely to the stacking direction and at least partially defining a respective channel through which a refrigerant is flowable; and a plurality of openings;

a block attached to the cover disc; and at least one component attached to the block;

wherein a first opening of the plurality of openings is disposed in a first connecting piece of the plurality of connecting pieces;

wherein a second opening of the plurality of openings is disposed in a first elongated hollow dome of the plurality of domes and is in direct fluid communication with a first channel defined by the first dome;

wherein the block and/or the at least one component is fluidically connected with at least one of the plurality of openings;

wherein a flow path of the refrigerant extends through the heat exchanger, the block, and the at least one component;

wherein the at least one component includes i) a collector for collecting the refrigerant, ii) a first valve, and iii) a second valve; and wherein the first valve and the second valve are each attached to the block and fluidically connected with the block.

17. The thermal management module according to claim 16, wherein the first connecting piece is disposed spaced apart from the plurality of domes.

18. The thermal management module according to claim 16, wherein the plurality of openings are coplanar.

19. The thermal management module according to claim 16, wherein:

a third opening of the plurality of openings is disposed in a second elongated hollow dome of the plurality of domes and is in direct fluid communication with a second channel defined by the second dome; and the first opening, the second opening, and the third opening are in direct fluid communication with the block.

* * * * *